US005157209A

United States Patent [19]

Dunn

[11] Patent Number: 5,157,209

[45] Date of Patent: Oct. 20, 1992

[54] SEMI-AUTOMATIC SAFETY HANDGUN

[76] Inventor: Peter B. Dunn, 709 N. 32nd St., Renton, Wash. 98056

[21] Appl. No.: 814,406

[22] Filed: Dec. 23, 1991

[51] Int. Cl.[5] ..... F41A 17/72

[52] U.S. Cl. ..... 42/70.08; 89/145; 89/148; 89/154

[58] Field of Search ..... 42/70.08; 89/145, 148, 89/150, 154

[56] References Cited

U.S. PATENT DOCUMENTS

| | | | |
|---|---|---|---|
| 580,925 | 4/1897 | Browning | 89/145 |
| 3,184,876 | 5/1965 | Walther | 52/70.08 |
| 3,724,113 | 4/1973 | Ludwig | 42/70.08 |
| 3,750,531 | 8/1973 | Angell et al. | 42/70.08 |
| 4,021,955 | 5/1977 | Curtis | 42/70.08 |
| 4,203,348 | 5/1980 | Sokolovsky | 89/148 |
| 4,282,795 | 8/1981 | Beretta | 89/148 |
| 4,539,889 | 9/1985 | Glock | 89/147 |
| 4,555,861 | 12/1985 | Khoury | 42/70.08 |
| 4,590,697 | 5/1986 | Ruger et al. | 42/70.08 |

*Primary Examiner*—Stephen C. Bentley
*Attorney, Agent, or Firm*—Michael J. Folise

[57] ABSTRACT

In a semi-automatic firearm is a simplified firing mechanism that includes a manual safe y system and a doubly redundant automatic safety system. The firing mechanism includes a trigger, a trigger bar, a trigger lever, a firing pin safety, spring loaded striker with a firing pin, a sear, a dislocator and a manual safety. When the manual safety is in the safe position the striker is blocked and the trigger bar is disengaged from the sear and the dislocator. If the manual safety is in the firing position, but the trigger has not been fully released after each discharge, the trigger lever cannot move the firing pin safety out of the way of the striker, and the trigger bar cannot move the sear.

21 Claims, 8 Drawing Sheets

SEMI-AUTOMATIC SAFETY HANDGUN

TECHNICAL FIELD

The present invention relates to semi-automatic firearms which eject the spent cartridge and chamber a fresh cartridge after each shot. More particularly, this invention relates to automatic and manual safety systems for preventing inadvertent discharge and automatic cycling of semi-automatic firearms.

BACKGROUND OF THE INVENTION

In the field of semi-automatic firearm designs various firing mechanisms exist which include both manual and automatic safety systems that function to reduce the possibility of inadvertently discharging a chambered cartridge.

Existing designs are complex and expensive to manufacture. For example: the devices disclosed in U.S. Pat. Nos. 4,282,795 to Beretta; 4,555,861 to Khoury; 4,021,955 to Curtis; 3,724,113 to Ludwig; and 4,590,697 to Ruger are hammer fired, therefore requiring complex parts which are costly to produce.

Many existing safety systems reduce the combat readiness of the firearm, and conversely, to increase the combat readiness one must compromise the protection provided by the safety systems. For example: the Beretta, Ludwig, and Ruger patents are designed to be carried with the hammer uncocked, relying on a double action mechanism to discharge the first shot. As such they are unable to deliver a first shot as accurately and quickly as a single action design can. If one were to carry these pistols in the cocked, or single action condition, safety would be compromised.

U.S. Pat. No. 4,539,889 to Glock discloses a striker fired mechanism with fewer parts, but requires a trigger pull similar to a double action mechanism for every shot.

Firing pin blocking safety systems are well known and are incorporated in pistols currently manufactured. However, the existing mechanisms incorporating these safety systems do not provide enough protection in the known areas of inadvertent discharge. For example, in the event of a sear failure: the Glock and Khoury patents are able to approach the battery position in a fail-unsafe condition; the Ludwig and Curtis patents may approach battery fail-unsafe if there is an imbalance of spring pressures within their mechanisms.

Currently manufactured pistols based on the Glock and Ludwig patents are without a manual safety, and as such may be discharged by any form of inadvertent trigger pull.

In view of the above, a need exists for a novel firearm design which has: a simple firing mechanism which is inexpensive to manufacture; multiple safety systems which prevent as many of the known types of inadvertent discharge as possible; and superior combat readiness without compromising safety features.

SUMMARY OF THE INVENTION

The invention achieves these and other objects and advantages which will become apparent from the description that follows by providing the semi-automatic, hammerless firearm having a barrel adapted to chamber a cartridge, a frame with a removable slide, and a fail-safe automatic safety system.

In its preferred embodiment, the invention is incorporated into a striker-type firearm having a manual safety which moves the striker rearwardly away from a chamber cartridge when activated, blocks any forward movement of the striker, and simultaneously disengages the trigger from the striker. In addition to this manual safety, a doubly redundant, automatic safety system incorporating a first automatic safety mechanism and a second automatic safety mechanism is provided. The first automatic safety mechanism blocks forward motion of the striker and is located between the striker and a chambered cartridge. The first automatic safety mechanism is biased to a safe position and can only be moved to a firing position when the slide is in a ready to fire position, and the trigger has been fully released after a cycle. The second automatic safety mechanism disconnects the trigger from the striker while the slide is cycling and does not permit re-engagement of the trigger with the striker at the end of the cycle until the trigger has been fully released.

Various embodiments of the invention are disclosed in which the mechanical features described above are located at physically disparate positions on the firearm.

DETAILED DESCRIPTION OF THE PREFERRED EMBODIMENTS

Figure 1:
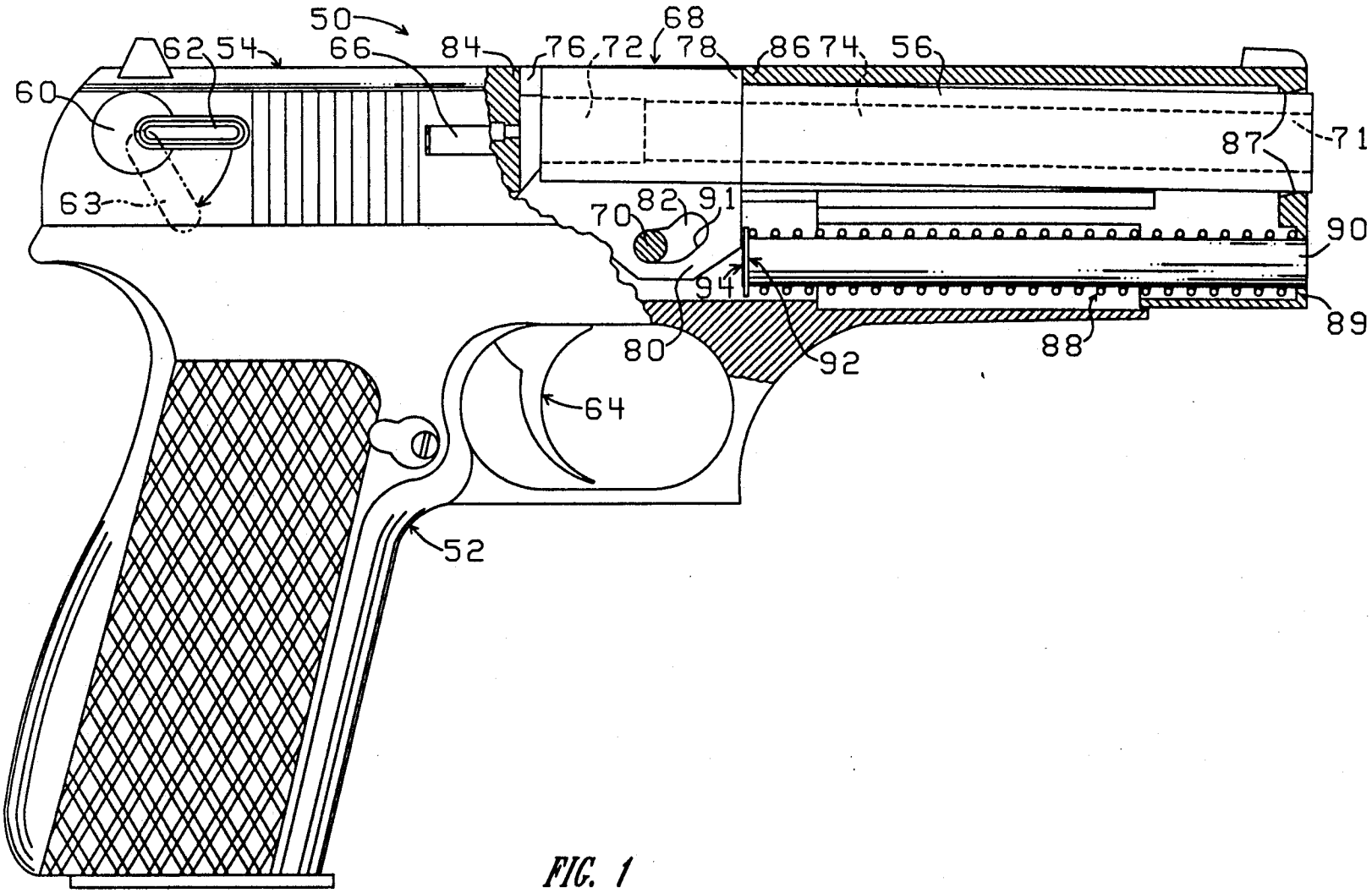
FIG. 1 is a side elevational view, partly in section, showing the conventional features of a semi-automatic firearm embodying the present invention.

The conventional features of the present invention are best illustrated in FIG. 1.

Turning to FIG. 1, there is shown a semi-automatic firearm 50 having a frame 52, a slide 54, a barrel 56, a manual safety 60 with a safety lever 62 which has a firing position (shown) and a safety position 63 shown in phantom. The firearm also has a trigger 64, an extractor 66 for expelling a spent cartridge, and an ejection port 68 through which the rearward portion of the barrel 56 is exposed. Also shown is a slide stop pin 70 which is seated transversely through the frame 52.

The barrel 56 has formed therein a muzzle 71 at its forward end and a chamber 72 at its rearward end and a bore 74. The upper rear portion of the barrel 56 has a hood 76 and a locking lug 78 formed thereon which are configured to fit in the upper portion of the ejection port 68. The lower rear portion of the barrel 56 has formed thereon a camming lug 80 with a camming slot 82 formed therein through which the slide stop pin 70 passes. The fit of the hood 76 and the locking lug 78 in the upper portion of the ejection port 68 is such that the hood 76 is positioned just forward of a breech face 84, and the locking lug 78 is positioned just rearward of a ledge 86 in the slide 54, thus locking the barrel 56 to the slide 54 when the slide 54 is in battery, i.e., the ready position for discharging a chambered cartridge The barrel 56 is therefore supported primarily by an annular camming surface 87 at the forward end of the slide 54, and by the stop pin 70.

A recoil spring 88 is fixed about an elongated, cylindrical spring guide 90 which has a flange 92 formed on its rearward end. Formed into the frame 52 is an abutment 94 against which the flange 92 seats so that the guide 90 remains stationary. The recoil spring 88 normally urges the slide 54 in a forwardly direction with respect to the frame 52.

The manner in which the barrel 56 cooperates with the slide 54 during recoil is well known. When recoil forces are generated upon discharging the firearm 50, initially both the slide 54 and the barrel 56 move rearwardly together, compressing the recoil spring 88 against a shoulder 89 at the front end of the slide. However, when a diagonal portion 91 of the camming slot 82 contacts and rides on the slide stop pin 70 the rearward portion of the barrel 56 is moved downwardly so that the locking lug 78 clears the ledge 86, thus unlocking the barrel 56 from the slide 54. Subsequently, the slide 54 continues to move rearwardly, but the barrel 56, which is secured to the frame 52 against further rearward motion by the slide stop pin 70, remains stationary. The spent cartridge (not shown) is extracted and ejected through the ejection port 68.

After the slide 54 has been moved fully rearward by the recoil forces, it will be returned toward battery by the recoil spring 88 and will insert a fresh cartridge (not shown) into the chamber 72. The slide 54 will then engage the barrel 56 and continue forwardly to the battery position previously described.

The safety features of the present invention are accompanied by a mechanically simple mechanism for discharging the firearm 50. An automatic safety system prevents inadvertent discharge when the firearm 50 is in use, and a manual safety system provides an extraordinary means for maintaining the firearm 50 in a safe condition when not in use. These novel features are best illustrated in FIGS. 2–15.

Figure 3:
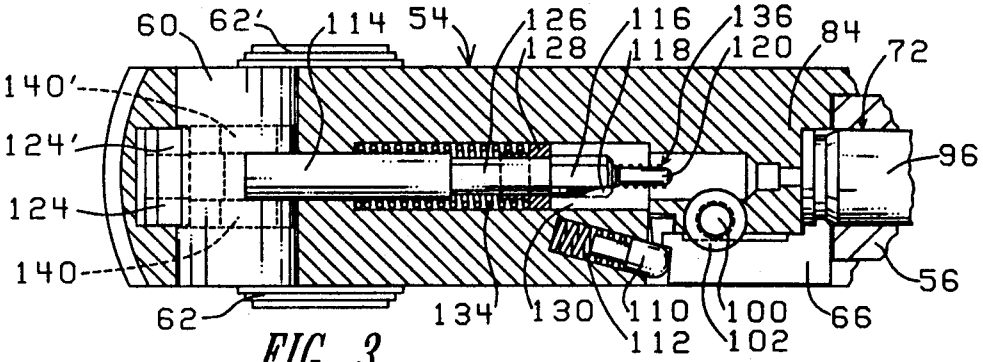
FIG. 3 is a fragmented, top plan, sectional view showing the mechanism within the slide.
Figure 2:
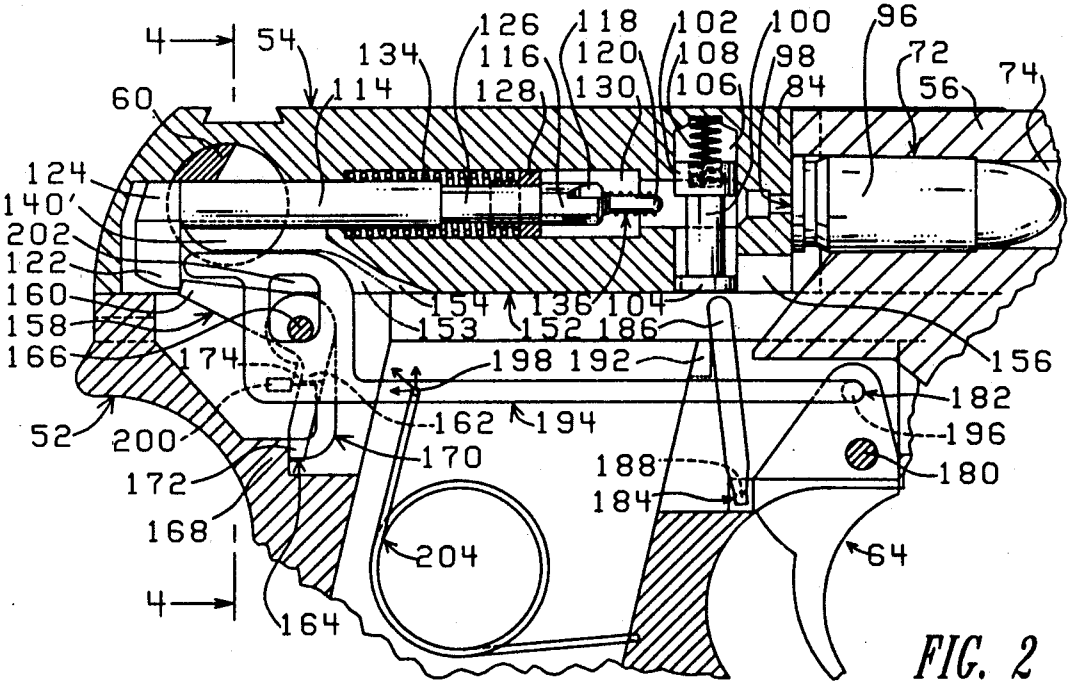
FIG. 2 is a fragmented, side elevational, sectional view showing the firing mechanism.
Figure 4:
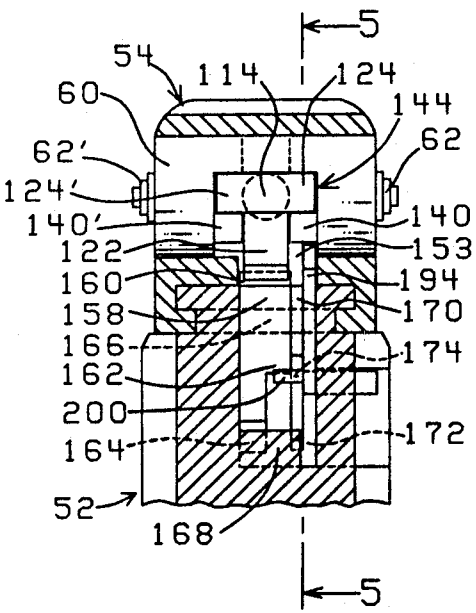
FIG. 4 is a rear sectional view along line 4—4 of FIG. 2.
Figure 5:
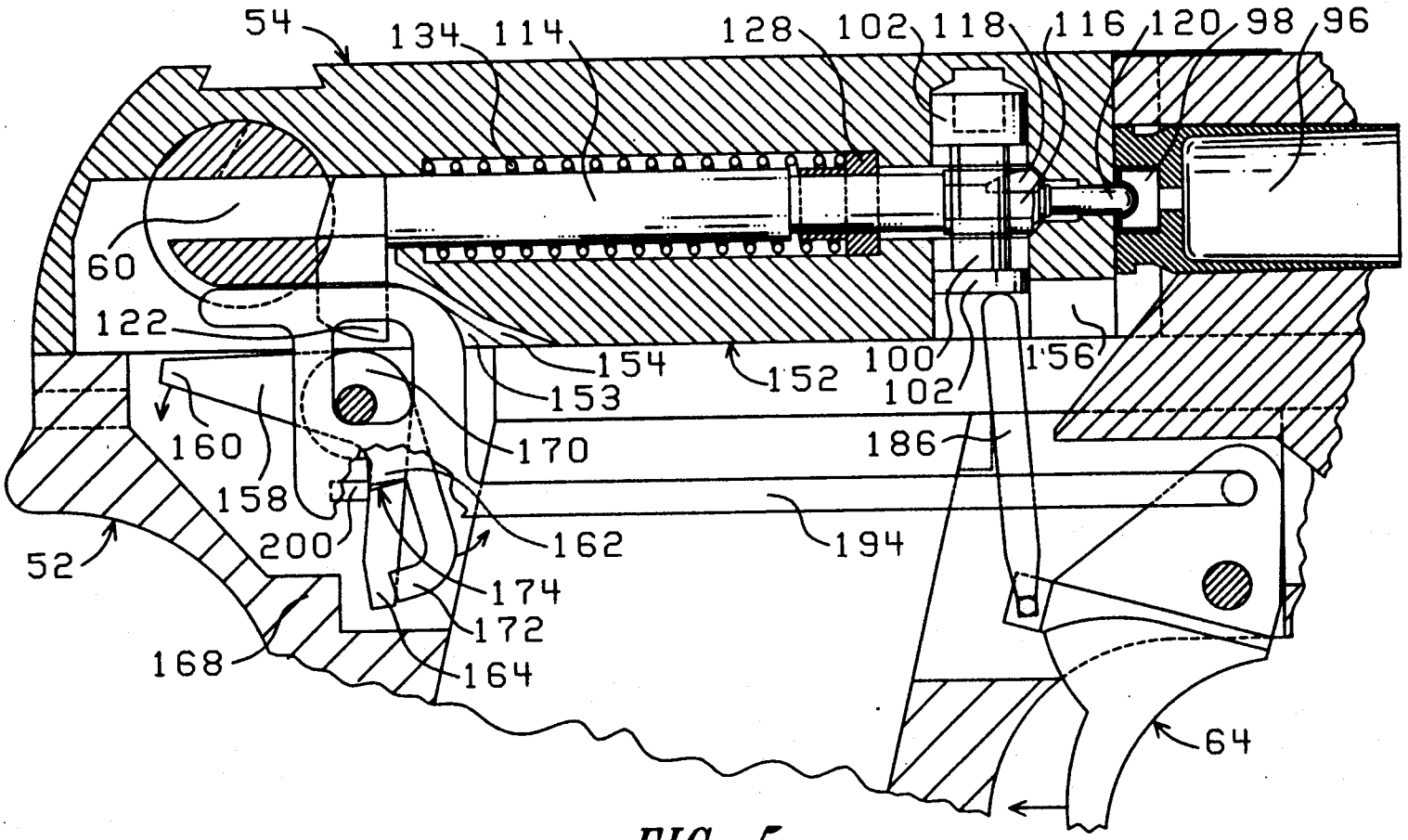
FIG. 5 is a fragmented, side elevational, sectional view; line 5—5 of FIG. 4 being the sectional plane for the manual safety; showing the mechanism when the trigger is pulled and the cartridge is discharged.

As best seen in FIGS. 2–4, a cartridge 96 including a primer 98 is inserted in the chamber 72 of the barrel 56 (see also FIG. 5). Rearward of the breech face 84 and carried within the slide 54 is a firing pin safety 100 of a conventional shape. The firing pin safety 100 blocks forward motion of the firing pin (thus preventing discharge) except during certain prescribed portions of a firing cycle. The upper portion of the firing pin safety 100 has formed thereon a top 102. The lower portion of the firing pin safety 100 has formed thereon a base 104. The firing pin safety 100 is vertically moveable within a cavity 106 and is normally urged downward by a spring 108, which downward movement may be limited by any conventional means. Also shown in FIG. 3 is a plunger 110 and a plunger spring 112 which function to urge the extractor 66 towards the cartridge 96 in a conventional manner.

The slide 54 carries a striker 114, which are well known. The striker 114 has formed on its forward portion a firing pin head 116 having a recessed area 118, and a firing pin 120. Formed on a rearward portion of the striker 114 is a leg 122 which projects downward, and a pair of shoulders 124 and 124' which project laterally. Also formed on the striker 114 is a reduced diameter section 126 which is straddled by a spring cup 128. The striker 114 is reciprocally moveable in a cavity 130. A striker spring 134 bears against the spring cup 128 thereby urging the striker 114 towards the cartridge 96. A rebound spring 136 is mounted on the firing pin 120.

As best seen in FIGS. 1, 3 and 4, the manual safety 60 is rotatably mounted in the rearward portion of the slide 54 and has formed thereon a pair of conventional thumb levers 62 and 62'. The manual safety 60 also has formed therein a pair of safety lugs 140 and 140'. The configuration of the safety lugs 140 and 140' is such that a "T" shaped cavity 144 is formed through which the striker leg 122 and the shoulders 124 and 124' may freely pass when the safety 60 is in the firing position (shown in solid lines in FIG. 1). The novel function and safety advantages of the safety lugs 140 and 140' in co-operation with the striker shoulders 124 and 124', respectively, and of the "T" shaped cavity 144, will be further explained hereinafter with reference to subsequent figures.

The slide 54 has formed thereon a lower surface 152. The rearward portion of the surface 152 has formed therein a recessed area 153 through which the safety lug 140 is exposed towards the frame 52. Approximately adjacent to the recessed area 153 is formed another recessed area 154. Also formed into the slide 54, upwardly from the lower surface 152 and passing from the firing pin safety cavity 106 through the breach face 84, is a recessed area 156. The purposes of the lower surface 152 and the recessed areas 153, 154, and 156 will be further explained hereinafter with reference to subsequent figures.

A sear 158 is pivotally mounted about a horizontal axis within the rearward portion of the frame 52. The sear along with other components to be discussed further below serves to connect the trigger 64 to the striker 114. The upper rearward portion of the sear 158 has formed thereon a nose 160. The lower middle portion of the sear 158 has formed thereon a downwardly and rearwardly projecting ledge 162. The lower portion of the sear 158 has formed thereon a foot 164. The sear 158 is normally urged to rotate clockwise about a sear pin 166, by a spring (not shown) and is limited by the foot 164 which seats against a ledge 168 formed in the frame 52. The sear nose 160 is therefore normally urged upwardly into the path of the striker leg 122 thereby restraining the forward movement of the striker 114 in a conventional manner when the slide 54 is in battery.

Figure 2A:
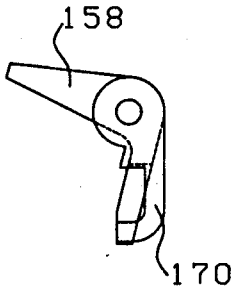
FIGS. 2*a*–2*b* are side and rear elevational views of a sear and dislocator employed by the invention.
Figure 2B:
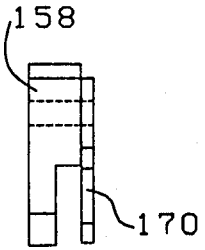

Also pivotally mounted in the frame 52, adjacent to the sear 158, and rotatable about the sear pin 166 is a dislocator 170. The dislocator along with other components to be described further below serves to disconnect the trigger 64 from the sear 158 except at appropriate times during a firing cycle to provide a redundancy of safety. The lower portion of the dislocator 170 has formed thereon a foot 172. The middle portion of the dislocator 170 has formed thereon a ledge 174. The dislocator 170 is normally urged to rotate clockwise about the sear pin 166, which rotation may be accomplished by a spring (not shown) and is limited by the foot 172 which seats against the ledge 168. The novel function of the dislocator 170 will be further explained hereinafter with reference to subsequent figures. Elevational and rear views of the sear 158 and dislocator 170 are shown in FIGS. 2*a* and 2*b*, respectively.

The trigger 64 is pivotally mounted within the frame 52 by means of a trigger pin 180, about which the trigger 64 rotates. The upper portion of the trigger 64 has formed therein a cylindrical bore 182. The rearward portion of the trigger 64 also has formed therein a cylindrical bore 184. The purpose of the cylindrical bores 182 and 184 will be further explained hereinafter.

A trigger lever 186 is pivotally mounted to the trigger 64. Formed on the lower end of the trigger lever 186 is an axle 188 which is inserted in the cylindrical bore 184. The trigger lever 186 is normally urged to rotate counterclockwise about the axle 188, by a spring (not shown) and is limited by a lug 192 formed in the frame 52 against which the upper portion of the trigger lever 186 bears. The novel function of the trigger lever 186 in co-operation with the firing pin safety 100 will be further explained hereinafter with reference to subsequent figures.

A trigger bar 194 is attached to the trigger 64 by means of a pivot lug 196 which is formed on the forward portion of the trigger bar 194 and is inserted in the cylindrical bore 182. The rearward portion of the trigger bar 194 has formed therein a cylindrical bore 198, and further rearward there is formed thereon laterally projecting a finger 200. The upper rearward portion of the trigger bar 194 has formed therein a rectangular opening 202 which is configured around the sear pin 166.

A trigger bar spring 204 is attached to the frame 52 in a conventional manner and has one end inserted in the cylindrical bore 198 such that the rearward portion of the trigger bar 194 is normally urged both upwardly and rearwardly with respect to the frame 52. The movements of the rearward portion of the trigger bar 194 are limited by the surfaces of the opening 202 which ride against the sear pin 166. The rearwardly urging of the trigger bar 194 by the spring 204 causes the trigger 64 to rotate counterclockwise about the trigger pin 180 into the at-ready position. This counter-clockwise rotation is limited by the rearward portion of the trigger 64 which seats against the frame 52.

The movements and positions of the aforementioned parts are determined by the operation and handling of the firearm 50 and will be further explained with reference to subsequent figures.

OPERATION OF AUTOMATIC SAFETY FEATURES

Turning now to FIG. 5, the trigger 64 is pulled, which caused the trigger bar 194 to move forward. As the trigger is pulled, the finger 200 first engages the dislocator ledge 174 which rotates the dislocator 170 counterclockwise. Concurrently the trigger lever 186 moves upwardly, engages the firing pin safety base 104, and pushes the firing pin safety 100 upward such that the top 102 moves out of the path of the firing pin head 116.

As the trigger pull continues, the finger 200 next engages the sear ledge 162 and rotates the sear 158 counterclockwise, which rotation moves the sear nose 160 downwardly and out of the path of the striker leg 122. Consequently, the striker 114 is propelled towards the cartridge 96 by the striker spring 134. The firing pin 120 impacts the primer 98, and the cartridge 96 is discharged.

Following each discharge, the slide 54 will be driven rearwardly by recoil forces and will eject the spent cartridge 96 as previously described. The rearward portion of the trigger bar 194 will be moved downwardly to the position shown in FIG. 6 as the surface of the recessed area 153 and the slide lower surface 152 ride on the upper rearward surface of the trigger bar 194. Consequently the finger 200 will be disengaged from both the sear ledge 162 and the dislocator ledge 174, thus releasing the sear 158 and the dislocator 170 to rotate clockwise. The rotation of the sear 158 will be limited during recoil by the sear nose 160 which will ride against the slide lower surface 152. The rotation of the dislocator 170 will continue until the foot 172 seats against the frame ledge 168. The recessed area 156 near the breach face 84 provides a passage for the trigger lever 186, which will disengage from contact with the firing pin safety base 104. Thus the firing pin safety 100 will return downwardly until the top 102 bears against the firing pin head 116.

When the rearwardly travel of the slide 54 ceases, the striker 114 will continue to move rearwardly, urged by kinetic energy and the rebound spring 136, (see FIG. 2), until the firing pin head 116 contacts the striker spring cup 128. Subsequently, the firing pin safety 100 will return fully downwardly to its resting position with the top 102 nested in the firing pin head recessed area 118.

Figure 6:
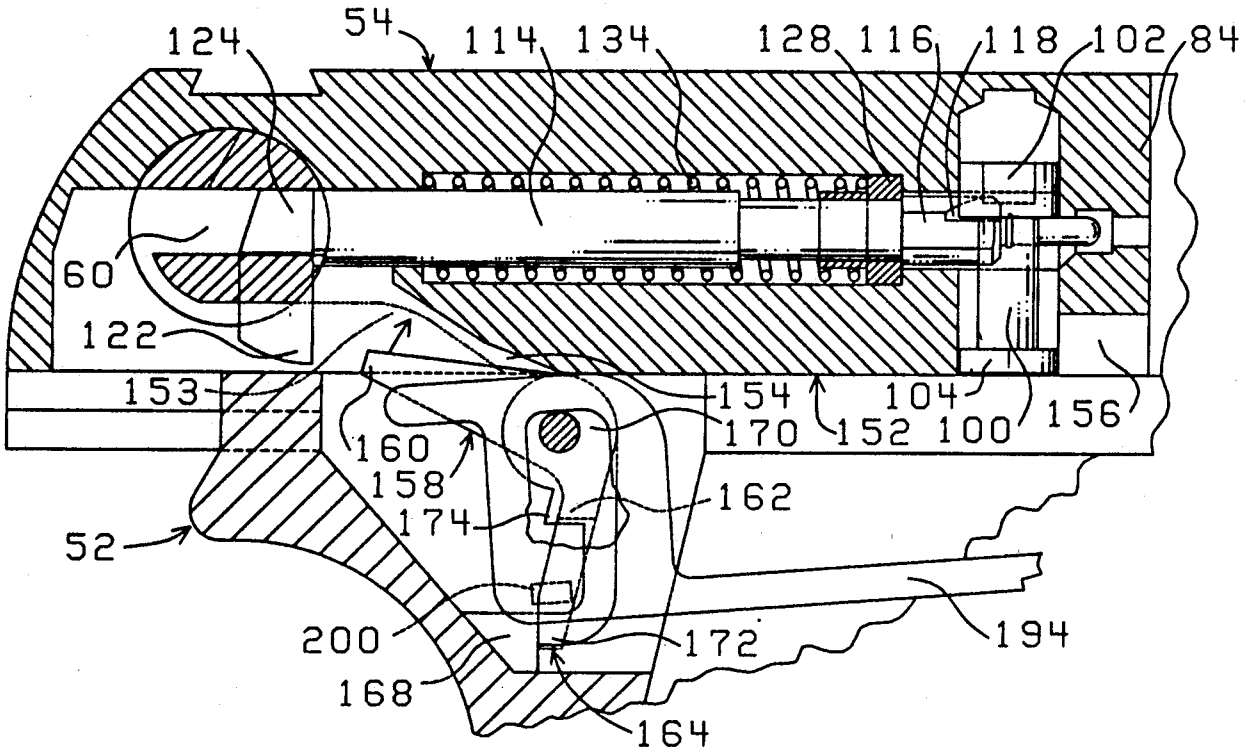
FIG. 6 is a fragmented, side elevational, sectional view showing the mechanism as the slide moves towards battery following recoil.

Still with reference to FIG. 6, the slide 54 returns forwardly toward battery, as previously described. Subsequently, the recessed area 154 allows the sear nose 160 to move upwardly into the path of the striker leg 122, which will restrain the striker 114. The recoil spring 88 (see FIG. 1) is sufficiently strong to overpower the striker spring 134 thereby loading the striker spring 134 as the slide 54 continues toward battery.

Figure 7:
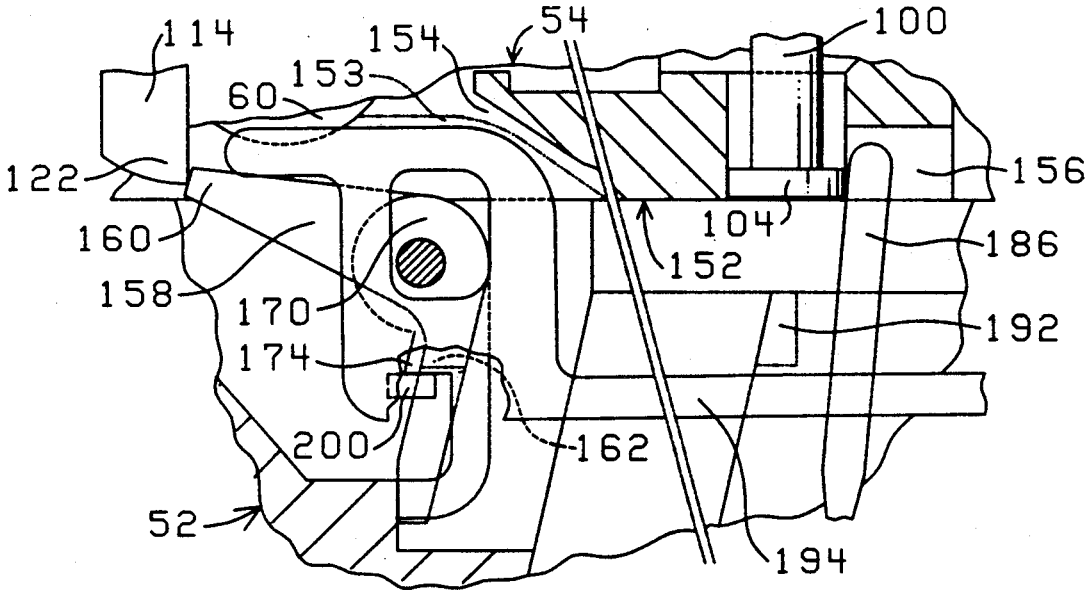
FIG. 7 is an enlarged, fragmented, sectional view showing the positions of the trigger bar and the trigger lever after the slide has returned to battery following recoil and the trigger is still in the pulled condition.

Turning now to FIG. 7, as the slide nears battery, the rearward portion of the trigger bar 194 moves upwardly into the slide recessed area 153 until the finger 200 bears against the lower surface of the dislocator ledge 174. The firing pin safety base 104 is about to engage the upper portion of the trigger lever 186 which will then be pivoted forwardly in the slide recessed area 156 until the slide 54 reaches battery. Thus the approach to battery is safeguarded by the blocking position of the firing pin safety 100.

It can be visualized that as the trigger 64 (see FIG. 5) is released the trigger lever 186 will move downwardly while bearing against the firing pin safety base 104. Concurrently, the trigger bar 194 will move rearwardly with its finger 200 bearing against the dislocator ledge 174.

Figure 8:
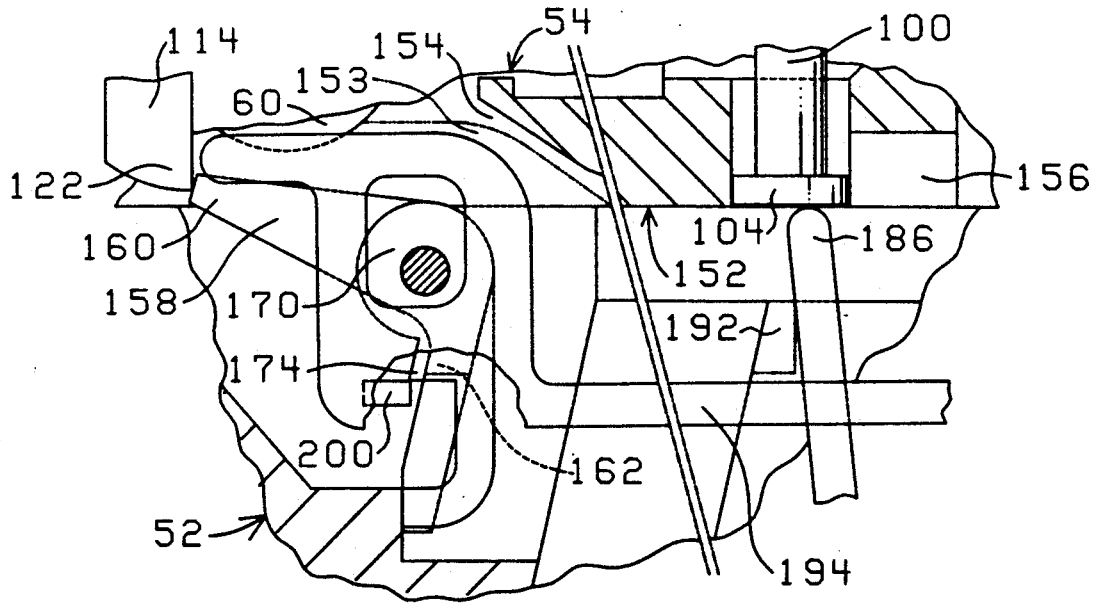
FIG. 8 is a view similar to FIG. 7 showing the trigger lever repositioned beneath the firing pin safety before the trigger bar can reposition for subsequent discharge. The trigger has not yet fully returned to the resting position.
Figure 10:
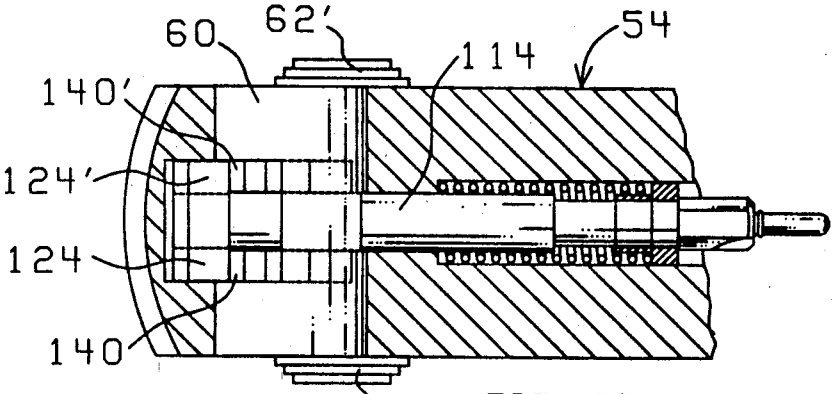
FIG. 10 is a view similar to FIG. 3 showing the manual safety in the safe position.
Figure 9:
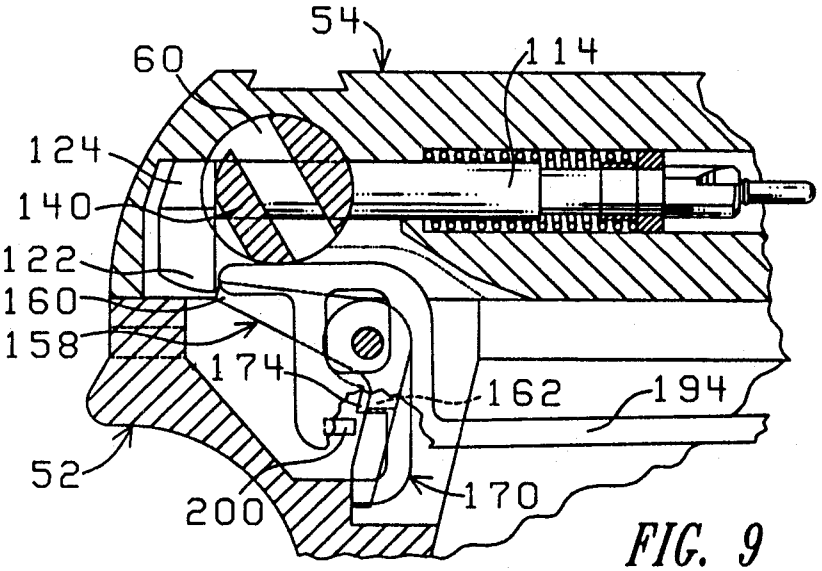
FIG. 9 is an enlarged partial view similar to FIG. 2; showing the manual safety in the safe position.
Figure 11:
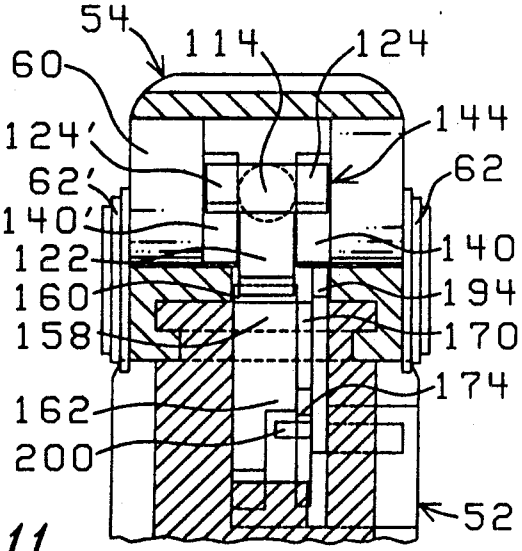
FIG. 11 is a view similar to FIG. 4 showing the manual safety in the safe position.

Turning now to FIG. 8, it can be seen that the dislocator ledge 174 is rearwardly and downwardly extended to sufficiently co-operate with the finger 200 such that the trigger bar 194 can not reposition with respect to the sear ledge 162 for discharge until after the trigger lever 186 has pivoted rearwardly beneath the firing pin safety base 104. Consequently, in the event that the trigger 64 (see FIG. 5) is not fully released before being pulled again, the striker 114 can not be released, and as such will not be able to impact inadvertently against the firing pin safety 100. This feature forces the user to fully release the trigger before firing a subsequent shot and obviates any possibility of a fully automatic firing sequence, or jamming of the firing mechanism under adverse conditions.

In the operating and handling sequences described above, the functioning of the trigger lever 186 and its co-operation with the firing pin safety 100, in conjunction with the dislocator 170 and its cooperation with the trigger bar 194 automatically provides a redundant means of protection against inadvertent discharge. Furthermore, the interrelated operation of these redundant automatic safety systems renders remanufacture or conversion of the firearm 50 into a fully automatic weapon virtually impossible.

OPERATION OF THE MANUAL SAFETY

Turning now to FIGS. 6, and 9–11, it can be seen that when the manual safety 60 is rotated to the safety position 63 (see FIG. 1) the rearward portions of the safety lugs 140 and 140' engage the striker shoulders 124 and 124', respectively. The safety lugs 140 and 140' are configured such that the striker 114 is moved rearwardly and blocked securely. Additionally, the forward portion of the safety lug 140 moves the rearward portion of the trigger bar 194 downwardly such that the laterally extending finger 200 of the trigger bar is positioned below both the sear ledge 162 and the dislocator ledge 174.

It can be seen that a multiplicity or redundancy of positive safety means, each of which is able to prevent the firearm 50 from inadvertent discharge, are effected when the manual safety 60 is rotated to the safety position 63. For example, the striker shoulders 124 and 124' are of relatively great strength and are most rigidly blocked by the safety lugs 140 and 140', respectively, and the "T" shaped cavity 144 is rotated out of alignment with the striker shoulders 124 and 124', thereby obviating any forward movement of the striker 114; also the sear nose 160 remains in the path of the striker leg 122 and cannot be rotated out of the way because the trigger bar has been fully disconnected by dislocation therefrom.

Therefore, as a result of the present invention, the firearm 50 is capable of providing overall safety conditions heretofore unobtainable by any of the known mechanisms.

FIGS. 12–15 show alternative embodiments of dislocator mechanisms according to this invention. Otherwise the firearm is substantially identical to that described herein.

Figure 12:
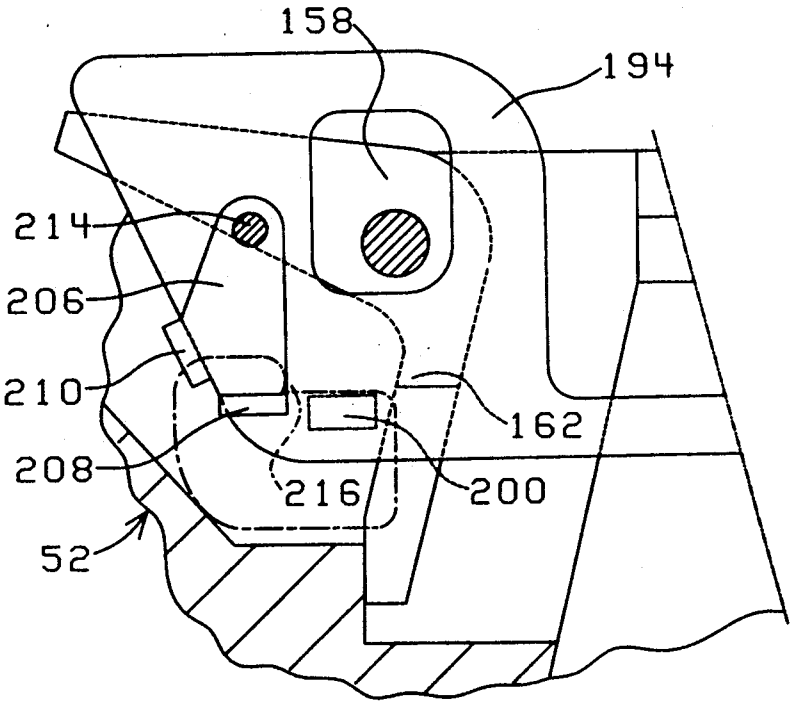
FIG. 12 is an enlarged partial view similar to FIG. 8 showing an alternative embodiment of the dislocator mechanism which can be mounted to the trigger bar.

Turning to FIG. 12, a dislocator 206 is pivotally mounted to the trigger bar 194. The lower portion of the dislocator 206 has formed thereon a ledge 208. The lower rearward portion of the dislocator 206 has formed thereon a stop 210. The dislocator 206 is normally urged to rotate counterclockwise about a dislocator pin 214 by any conventional means. The rotation of the dislocator 206 is limited by the stop 210 which seats against the rearward surface of the trigger bar 194. To accommodate this alternative embodiment the frame 52 has formed therein a ledge 216 with appropriate clearances thereabouts. It can be visualized that the frame ledge 216 will cooperate with the dislocator ledge 208, in a functionally similar manner to that which has been previously described, during the operation and handling of the firearm, to prevent the trigger bar 194 from repositioned for subsequent discharge until after the trigger lever 186 has repositioned as previously described, (see FIG. 8).

Figure 14:
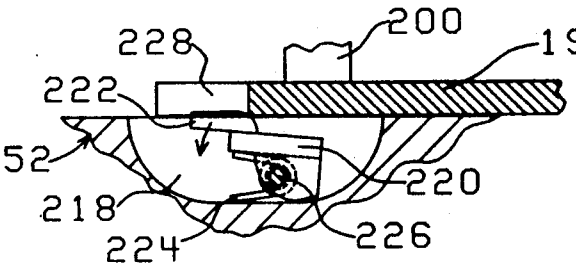
FIG. 14 is a fragmented, top plan sectional view along line 14—14 of FIG. 13.
Figure 13:
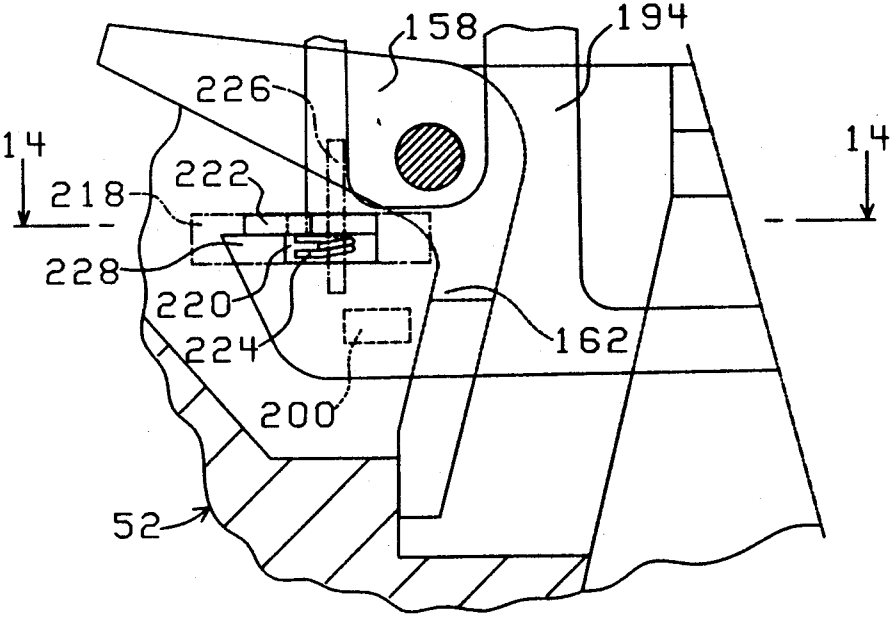
FIG. 13 is a view similar to FIG. 8 showing an alternative embodiment of the dislocator mechanism which can be mounted within the frame.

FIGS. 13 and 14 show that an inletting 218 formed within the frame 52 can house a pivotally mounted dislocator 220. The dislocator 220 has formed on its rearward end a ledge 222. A dislocator spring 224 normally urges the dislocator 220 to rotate clockwise about a dislocator pin 226. The trigger bar 194 has formed rearwardly thereon a ledge 228 which is configured to cooperate with the dislocator ledge 222. It can be visualized that the dislocator 220 will also accomplish the same purpose of preventing the trigger bar 194 from repositioning until after the trigger lever 186 has repositioned (see FIG. 8).

Figure 15:
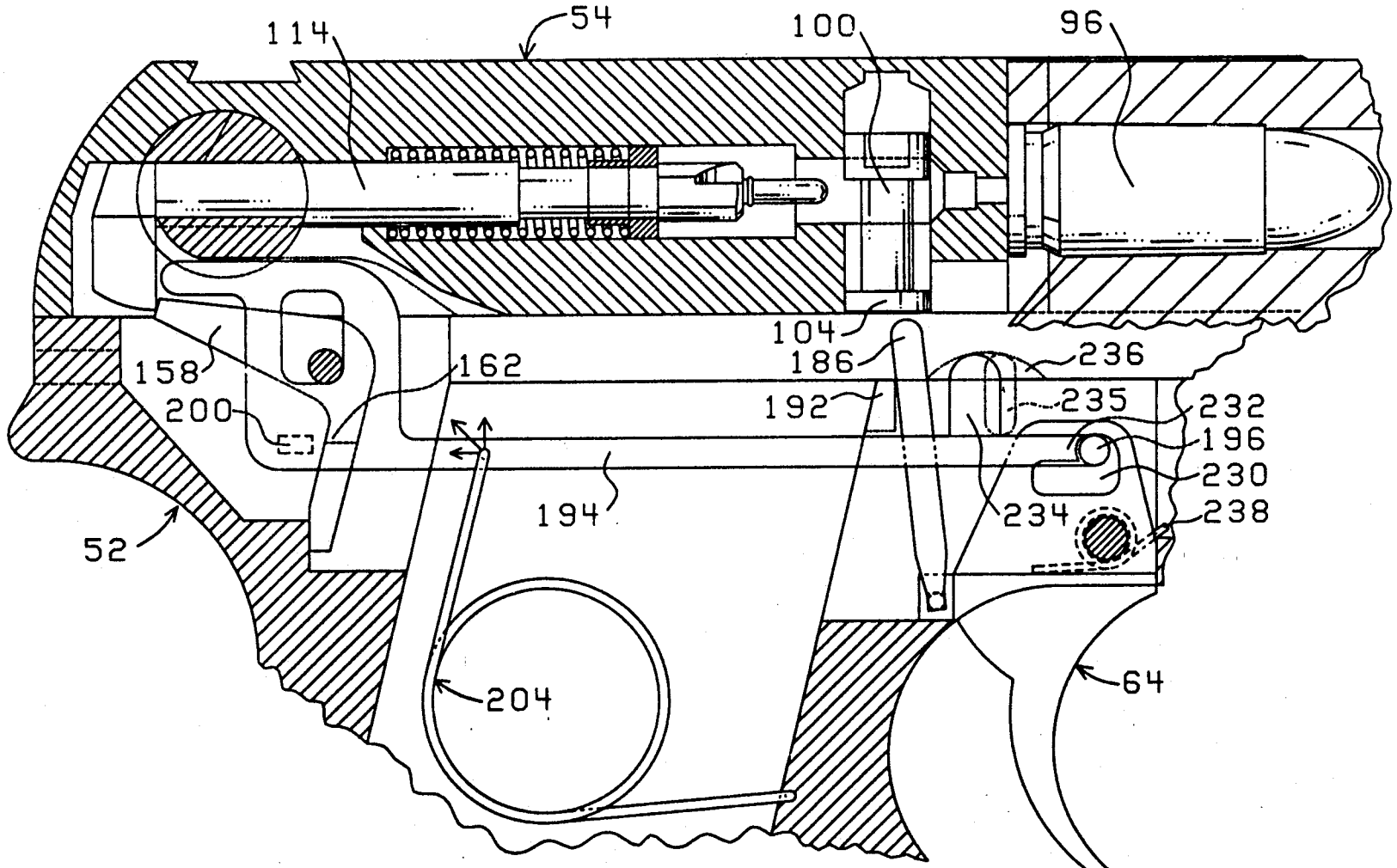
FIG. 15 is a view similar to FIG. 2 showing an alternative embodiment whereby the dislocator mechanism is functionally incorporated within the configurations of the trigger and trigger bar.

FIG. 15 shows yet another alternative embodiment whereby a dislocator is functionally incorporated within the configurations of the trigger 64 and the trigger bar 194. The upper portion of the trigger 64 has formed therein an opening 230 which has formed on its upward surface a ledge 232. The trigger bar 194 has formed on its upper forward portion an upright 234 which protrudes into a recess 236 which is formed into a lower surface of the slide 54. A conventional type of disconnector 235, which may be urged upwardly by any conventional means, may be incorporated in place of the upright 234. A conventional trigger return spring 238 may be incorporated to insure the return of the trigger 64 to its resting position.

The manner in which this alternative embodiment functions can now be visualized. As the slide 54 moves rearwardly following discharge, both ends of the trigger bar 194 will be moved downwardly simultaneously. Consequently the trigger bar pivot lug 196 is disengaged from the trigger ledge 232, and the finger 200 is disengaged from the sear ledge 162. With both ends of the trigger bar 194 disengaged, the trigger bar spring 204 urges the trigger bar 194 rearwardly and upwardly with respect to the frame 52. As the slide 54 returns to battery the rearward portion of the trigger bar 194 repositions without delay. However, the configuration of the trigger ledge 232 is such that the trigger bar pivot lug 196 is prevented from repositioning upwardly until the trigger 64 has been fully released. Thus, the trigger lever 186 has repositioned beneath the firing pin safety base 104 before the trigger 64 can actuate the trigger bar 194 for discharge.

All dislocator embodiments described herein will perform their prescribed functions whether the recoil cycle is effected by a discharge or by manual handling.

A dislocator therefore, according to the present invention, means any embodiment, or embodiments, incorporated in a semiautomatic firearm for the purpose of delaying the repositioning of a trigger bar, or similar embodiment actuated either directly or indirectly by a trigger, until after the repositioning of a trigger lever, or similar embodiment actuated either directly or indirectly by a trigger, following the recoil cycle.

Those of ordinary skill in the art will envision other alternative embodiments which employ the inventive concepts described above. Therefore, the invention is not to be limited by the above description, but should be determined in scope of the claims which follow.

I claim:

1. A fail safe system for a hammerless, semi-automatic firearm, comprising:

a frame, including a barrel having a breech for receiving a cartridge, a slide longitudinally moveable in a cycle between an at battery position adjacent to the breech and a full recoil position distal to the breech, a reciprocating spring loaded firing mechanism biased for striking the cartridge, and a trigger for releasing the firing mechanism;

a first automatic safety mechanism operatively connected to the trigger, having a blocking member positioned between the firing mechanism and the breech, the blocking member being biased to a firing mechanism blocking position and moveable to a firing mechanism passing position, the first automatic safety mechanism further having a blocking member connector, operatively associated with the trigger for moving the blocking member to the passing position only when the slide is in the at battery position and only after the trigger has been fully released; and a second automatic safety mechanism operatively interconnected to the trigger and the firing mechanism, having a first disengagement device for disconnecting the trigger from the firing mechanism when the slide is not in the at battery position, and having a second disengagement device for disconnecting the trigger from the firing mechanism by dislocation after a cycle until the trigger is fully released, whereby the firearm can not be accidentally discharged after a cycle until the trigger is fully released and the cycle is fully completed.

2. The fail safe system of claim 1, wherein the first disengagement device includes an elongated, rearwardly extending trigger bar pivotally connected to the trigger, and a sear pivotally connected to the frame and operatively interconnecting the trigger with the firing mechanism.

3. The fail safe system of claim 2, wherein the trigger bar has a protrusion thereon and wherein the slide has a corresponding detent therein positioned so that the trigger bar engages the sear when the slide is in the at battery position and so that the trigger bar disengages the sear when the slide is not at the battery position, whereby operation of the trigger during cycling of the firearm cannot release the firing mechanism.

4. The fail safe system of claim 3, wherein the protrusion and detent are internal to the frame and slide so as to be resistant to contamination and jamming.

5. The fail safe system of claim 2, wherein the second disengagement device has a dislocator pivotally connected to the frame and having timing means for preventing connection of the trigger bar with the sear after the trigger has been pulled and after a cycle until the trigger is fully released so as to prevent inadvertent fully automatic operation of the firearm under adverse conditions.

6. The fail safe system of claim 5, wherein the sear and dislocator have coincident pivot axes and wherein the timing means includes a downwardly and rearwardly projecting ledge on the sear, a further downwardly projecting sliding surface on the dislocator, and a laterally projecting finger on the trigger bar positioned so that the trigger bar finger rides on the dislocator sliding surface after a cycle and does not engage the sear ledge until the trigger is fully released.

7. The fail safe system of claim 5, wherein the sear and dislocator have perpendicular pivot axes and wherein the timing means includes a downwardly and rearwardly projecting ledge on the sear, an inwardly projecting sliding surface on the dislocator, and a dislocator ledge and a laterally projecting finger both on the trigger bar and positioned so that the trigger bar is downwardly constrained to locate the finger below the sear ledge during cycling thereby preventing operative interconnection of the trigger with the firing mechanism until the trigger is fully released.

8. The fail safe system of claim 2, wherein the second disengagement device has a dislocator structure incorporated in to the trigger, trigger bar and slide including means for downwardly displacing a forward end of the trigger bar into a longitudinal recess in the trigger when the slide is out of the battery position after the trigger has been pulled and after a cycle until the trigger is fully released so as to prevent inadvertent discharge or fully automatic operation of the firearm under adverse conditions.

9. The fail safe system of claim 2, wherein the blocking member connector has an upwardly directed lever pivotally connected to the trigger for urging the blocking member to the firing mechanism passing position when the slide is at the battery position, a cycle has been completed and the trigger has been fully released.

10. The fail safe system of claim 2, including a manually operated safety mechanism operatively interconnected with the firing mechanism and the trigger bar, the manually operated safety mechanism having an external lever for moving the manually operated safety mechanism between a safe and ready to fire position and having means for rearwardly displacing and blocking forward motion of the firing mechanism and simultaneously disengaging the trigger bar from the sear when the manually operated safety mechanism is in the safe position.

11. A fail safe system for a hammerless, semi-automatic firearm, comprising:

a frame, including a barrel having a breech for receiving a cartridge, a slide longitudinally moveable in a cycle between an at battery position adjacent to the breech and a full recoil position distal to the breech, a reciprocating spring loaded firing mechanism biased for striking the cartridge, and a trigger for releasing the firing mechanism;

a first automatic safety mechanism operatively connected to the trigger, having a blocking member positioned between the firing mechanism and the breech, the blocking member being biased to a firing mechanism blocking position and moveable to a firing mechanism passing position, the first automatic safety mechanism further having a blocking member connector, operatively associated with the trigger for moving the blocking member to the passing position only when the slide is in the at battery position and only after the trigger has been fully released; and a second automatic safety mechanism operatively interconnected to the trigger and the firing mechanism, having a disengagement device for disconnecting the trigger from the firing mechanism when the slide is not in the at battery position, whereby the firearm can not be accidentally discharged after a cycle until the cycle is fully completed.

12. The fail safe system of claim 11, wherein the disengagement device includes an elongated, rearwardly extending trigger bar pivotally connected to the trigger, and a sear pivotally connected to the frame and operatively interconnecting the trigger with the firing mechanism.

13. The fail safe system of claim 12, wherein the trigger bar has a protrusion thereon and wherein the slide has a corresponding detent therein positioned so that the trigger bar engages the sear when the slide is in the at battery position and so that the trigger bar disengages the sear when the slide is not at the battery position, whereby operation of the trigger during cycling of the firearm cannot release the firing mechanism.

14. The fail safe system of claim 13, wherein the protrusion and detent are internal to the frame and slide so as to be resistant to contamination and jamming.

15. The fail safe system of claim 12, wherein the blocking member connector has an upwardly directed lever pivotally connected to the trigger for urging the blocking member to the firing mechanism passing position only when the slide is at the battery position, a cycle has been completed and the trigger has been fully released.

16. The fail safe system of claim 12, wherein the disengagement device has a dislocator structure incorporated in to the trigger, trigger bar and slide including means for downwardly displacing a forward end of the trigger bar into a longitudinal recess in the trigger when the slide is out of the battery position after the trigger has been pulled and after a cycle until the trigger is fully released so as to prevent inadvertent fully automatic operation of the firearm under adverse conditions.

17. The fail safe system of claim 12, including a manually operated safety mechanism operatively interconnected with the firing mechanism and the trigger bar, the manually operated safety mechanism having an external lever for moving the manually operated safety mechanism between a safe and ready to fire position and having means for rearwardly displacing and blocking forward motion of the firing mechanism and simultaneously disengaging the trigger bar from the sear when the manually operated safety mechanism is in the safe position.

18. A fail safe system for a hammerless, semi-automatic firearm, comprising:

a frame, including a barrel having a breech for receiving a cartridge, a slide longitudinally moveable in a cycle between an at battery position adjacent to the breech and a full recoil position distal to the breech, a reciprocating spring loaded firing mechanism biased for striking the cartridge, a trigger connected to a trigger bar and a sear operatively interconnecting the trigger bar to the firing mechanism for releasing the firing mechanism when the trigger is depressed;

a first automatic safety mechanism operatively connected to the trigger, having a blocking member positioned between the firing mechanism and the breech, the blocking member being biased to a firing mechanism blocking position and moveable to a firing mechanism passing position, the first automatic safety mechanism further having a blocking member connector, operatively associated with the trigger for moving the blocking member to the passing position only when the slide is in the at battery position and only after the trigger has been fully released;

a second automatic safety mechanism operatively interconnected to the trigger and the firing mechanism, having a disengagement device for disconnecting the trigger from the firing mechanism when the slide is not in the at battery position; and a manually operated safety mechanism operatively interconnected with the firing mechanism and the trigger bar, the manually operated safety mechanism having an external lever for moving the manually operated safety mechanism between a safe and a ready to fire position and having means for rearwardly displacing and blocking forward motion of the firing mechanism and simultaneously disengaging the trigger bar from the sear when the manually operated safety mechanism is in the safe position, whereby the firearm can not be accidentally discharged after a cycle until the trigger is fully released and the cycle is fully completed.

19. The fail safe system of claim 18, wherein the trigger bar has a protrusion thereon and wherein the slide has a corresponding detent therein positioned so that the trigger bar engages the sear when the slide is in the at battery position and so that the trigger bar disengages the sear when the slide is not at the battery position, whereby operation of the trigger during cycling of the firearm cannot release the firing mechanism.

20. The fail safe system of claim 19, wherein the protrusion and detent are internal to the frame and slide so as to be resistant to contamination and jamming.

21. The fail safe system of claim 18, wherein the blocking member connector has an upwardly directed lever pivotally connected to the trigger for urging the blocking member to the firing mechanism passing position when the slide is at the battery position, a cycle has been completed and the trigger has been fully released.

* * * * *